United States Patent [19]

Mayes et al.

[11] Patent Number: 4,972,196

[45] Date of Patent: Nov. 20, 1990

[54] BROADBAND, UNIDIRECTIONAL PATCH ANTENNA

[75] Inventors: Paul E. Mayes, Champaign, Ill.; Michael D. Thomas, Hermosa Beach, Calif.

[73] Assignee: Board of Trustees of the Univ. of Illinois, Urbana, Ill.

[21] Appl. No.: 97,030

[22] Filed: Sep. 15, 1987

[51] Int. Cl.[5] ..... H01Q 1/38

[52] U.S. Cl. ..... 343/700 MS; 343/846

[58] Field of Search ..... 343/700 MS, 829, 830, 343/846, 767

[56] References Cited

U.S. PATENT DOCUMENTS

| | | | |
|---|---|---|---|
| 3,838,429 | 9/1974 | Reggia | 343/830 |
| 4,443,802 | 4/1984 | Mayes | 343/767 |
| 4,587,524 | 5/1986 | Hall | 343/767 |
| 4,710,775 | 12/1987 | Coe | 343/767 |
| 4,761,654 | 8/1988 | Zaghloul | 343/700 MS |

FOREIGN PATENT DOCUMENTS

| | | | |
|---|---|---|---|
| 56340 | 5/1979 | Japan | 343/700 MS |
| 97901 | 6/1983 | Japan | 343/700 MS |
| 217703 | 10/1985 | Japan | 343/700 MS |

*Primary Examiner*—Michael C. Wimer

*Attorney, Agent, or Firm*—Perman & Green

[57] ABSTRACT

A planar antenna is described which comprises a sandwich like structure of a radiating patch, ground plane and transmission feed line. Capacitive means connect the path to the feed line through a rectangular aperture in the ground plane. The energization of the feed line excites radiating modes in both the aperture and the space between the radiating patch and ground plane thereby resulting in an improved impedance bandwidth.

10 Claims, 3 Drawing Sheets

BROADBAND, UNIDIRECTIONAL PATCH ANTENNA

FIELD OF THE INVENTION

This invention relates to antennas, and more particularly, to very thin planar antennas that radiate or receive electromagnetic waves over a wide band of frequencies.

BACKGROUND OF THE INVENTION

In the last decade antennas constructed using printed circuit techniques have become very popular, especially for mobile applications. These antennas are often very thin and can be affixed to a vehicle, aircraft, etc. without appreciably altering the host structure. Since they do not protrude substantially from the surface upon which they are mounted, they cause little aerodynamic drag and have low susceptibility to mechanical damage. Also, they are generally economical to construct and light in weight. The antenna of this invention retains most of the advantages of planar antennas as outlined above, but greatly extends the operating capability at a cost of modest added complexity.

Many planar antennas of the prior art can be classified as high-Q resonant devices. The conventional microstrip patch antenna is in this category. Since the input impedance of such an antenna varies rapidly with a change of frequency in the vicinity of resonance, its operating bandwidth is severly limited, typically only a few percent.

Various designs have been proposed to overcome this problem. The combining of two elements that have complementary impedances has been successfully employed to produce near-constant impedance over a very wide band. See, for example, U.S. Pat. No. 3,710,340 which was issued to an inventor hereof on Jan. 9, 1973. In that invention a monopole and a cavity-backed slot were fed at the same position on a transmission line that continued past the two radiators and was then terminated at an arbitrary point with an impedance that was equal to the characteristic impedance of the line. The two radiators, the monopole and the slot, presented different impedance characteristics to the feeder. The monopole presented a shunt impedance which approached infinity as the frequency decreased. The slot presented a series impedance that approached zero as frequency decreased. By proper design these impedances were made very nearly complementary to one another.

In co-pending U.S. Pat. application Ser. No. 906,852 now U.S. Pat. No. 4,823,145 to Mayes and Tanner, another design is shown wherein the desired impedance characteristic is achieved by shaping the ground surface such that the ratio of the width of the radiating element to its distance from the ground surface stays constant for a given curvature.

SUMMARY OF THE INVENTION

The antenna of this invention is of the "patch" variety and has an impedance bandwidth that is much greater than that of a conventional microstrip patch. This increase in impedance bandwidth is obtained by simultaneously exciting two modes of the patch in a manner that presents complementary impedances to the same point on the input transmission line (feeder). From one point of view, this combination of impedances is introduced into the feeder to produce a two-port network with an image impedance that remains nearly constant over a wide frequency band. Another viewpoint that equally well explains the operation of the antenna, is that the wave which is reflected due to the effect of coupling to one mode of the patch is of equal magnitude but exactly out-of-phase with the reflected wave that is caused by the coupling to the other mode. This, under ideal conditions, causes the two reflected waves to cancel and produces zero net reflection and thus a theoretically perfect match of impedances of the radiator and the feeder.

The antenna of this invention employs two modes of the same radiating structure rather than separate elements (as in U.S. Pat. No. 3,710,340) to achieve complementary impedances. The radiator takes the form of a patch of thin conducting material which is positioned a small distance above and parallel to a large conducting ground surface. A transmission line conveys an electromagnetic wave to and from the antenna and is located on the opposite side of and parallel to the ground surface. A small slot aperture in the ground surface provides coupling to one mode of the patch. This mode is called the slot mode. Coupling to another mode, called the probe mode, is accomplished by connecting a capacitor from the transmission line below the ground surface, through the slot aperture, to the patch. The leads of the capacitor behave in a fashion similar to a short conductor, oftentimes called a probe (thus it is called the "probe" mode).

When an incident wave on the transmission line encounters the narrow slot, an electric field is established across the slot that produces an electromagnetic field in the region between the patch and the ground surface. This volume forms an electromagnetic resonator that leaks energy into the surrounding space through the gap around its periphery.

When the incident wave on the transmission line encounters the probe, i.e. the capacitor lead, the probe current also produces an electromagnetic field in the region between the patch and the ground surface. However, the configuration of this field is quite different from that excited by the slot, e.g. when the probe is located at the center of a circular patch, the probe-excited field will be independent of the azimuthal angle.

DETAILED DESCRIPTION OF INVENTION

Figure 1:
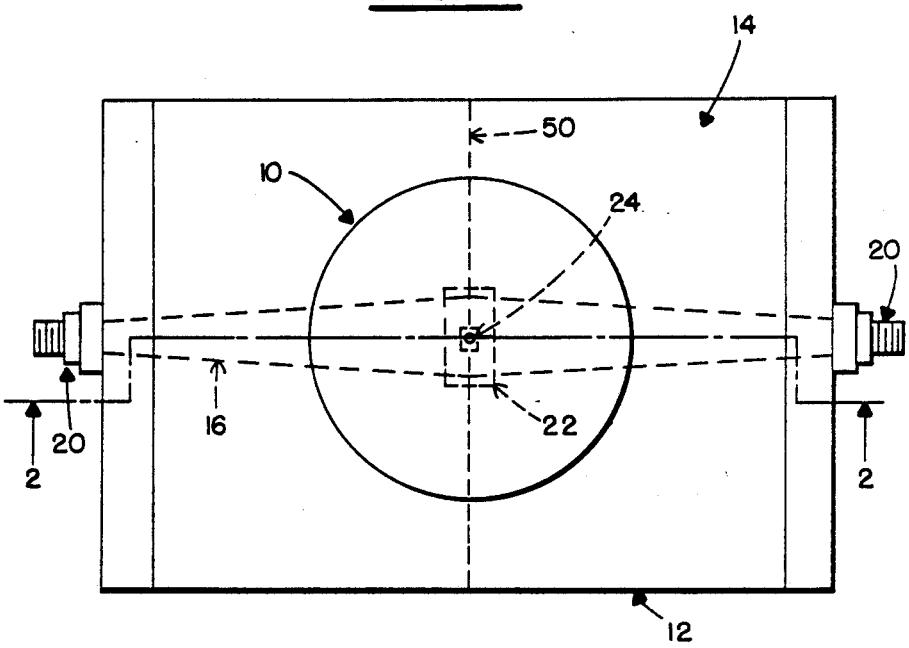
FIG. 1 is a top view of the invention showing a circular patch over a rectangular ground surface with a tapered microstrip feeder.
Figure 2A:
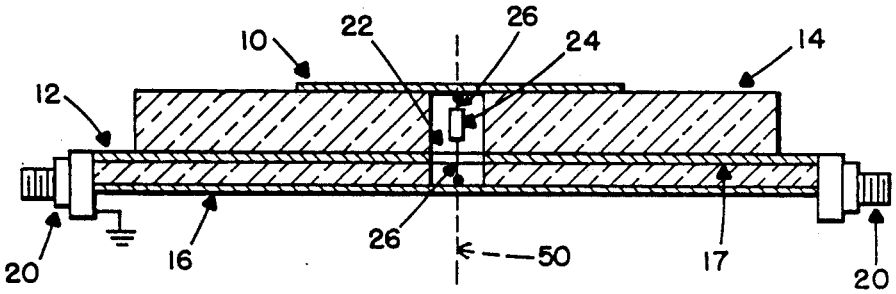
FIG. 2*a* is a sectional view of the invention of FIG. 1 taken along line 2—2.

Referring now to FIGS. 1 and 2a, the antenna is comprised of a patch 10 of conducting material, such as copper, aluminum, or brass, and a larger conducting ground surface 12. The patch 10 is held in position essentially parallel to and a short distance above the ground surface 12 by support member 14 made from a thin layer of low permittivity (foam or honey comb) dielectric. Support member 14 may be continuous, as shown, or may be a series of pedestals or other intermittent supporting structures. Ground surface 12 may, for example, be the surface of a host vehicle and could be expected, therefore, to extend a great distance away compared to the dimensions of the patch 10. The feeder is a tapered microstrip line 16 of conducting material parallel to and a short distance below ground surface 12. The separation between the ground surface 12 and feeder 16 is maintained by a thin layer of microwave dielectric 17, usually referred to as the substrate. Coaxial connectors 20 are connected at each end of feeder 16 to enable connection of the antenna to external circuitry.

Rectangular aperture 22 in ground surface 12 provides a means of coupling between the feeder 16 and patch 10. The exact shape of aperture 22 is not critical, but it should be relatively narrow and elongated, preferably with an aspect ratio greater than 10. A capacitor 24 (e.g. 5pF) and its leads 26 provide another independent means of coupling between the feeder 16 and the patch 10. The dimensions of patch 10 and the length of the slot 22 are used to control the resonant frequency of the slot mode of the patch. The value of the capacitance of the capacitor 24 is used to control the resonant frequency of the probe mode of the patch.

Figure 2B:
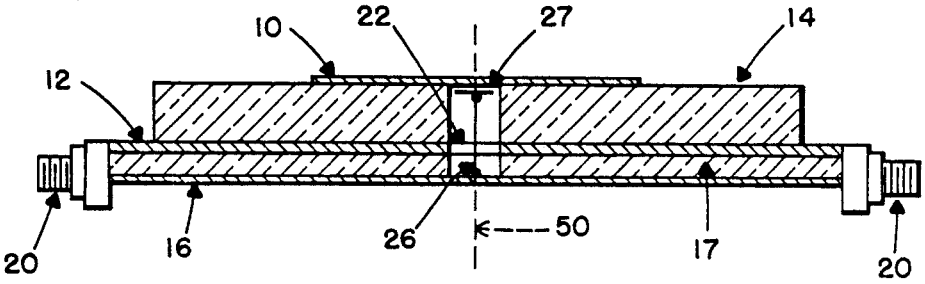
FIG. 2*b* is a sectional view of the invention showing an alternate capacitive coupling technique.

Capacitor 24 can be replaced, as shown in FIG. 2b, by placing a small, circular patch 27 below and insulated from larger radiating patch 10. While not shown, a thin layer of dielectric may be positioned between patch 27 and patch 10. A typical radius of the patch 27 is 5 mm, and it is placed less than 1 mm below patch 10.

The size of patch 10 is determined, to some extent, by the requirement to produce a significant amount of radiation. The length of the probe is limited by the need to maintain a low profile. But the achievement of complementary impedances requires that the resonant frequencies of the slot mode and the probe mode be identical. The series capacitor inserted in the probe conductor provides the required ability to adjust the resonant frequency of the probe mode. The resonant frequencies can thus be affected independently as the value of the capacitance is chosen to lower the resonant frequency of the probe mode until it is below that of the slot mode, while the aperture's length is used to lower the resonant frequency of the slot mode to that of the probe mode.

The excitation of the two modes can be adjusted so that the azimuthal radiation patterns have a cardioid shape. The elevation pattern is a half cardioid. Thus a single dual-mode patch has appreciable directivity in azimuth even though it is relatively small in size.

Figure 3:
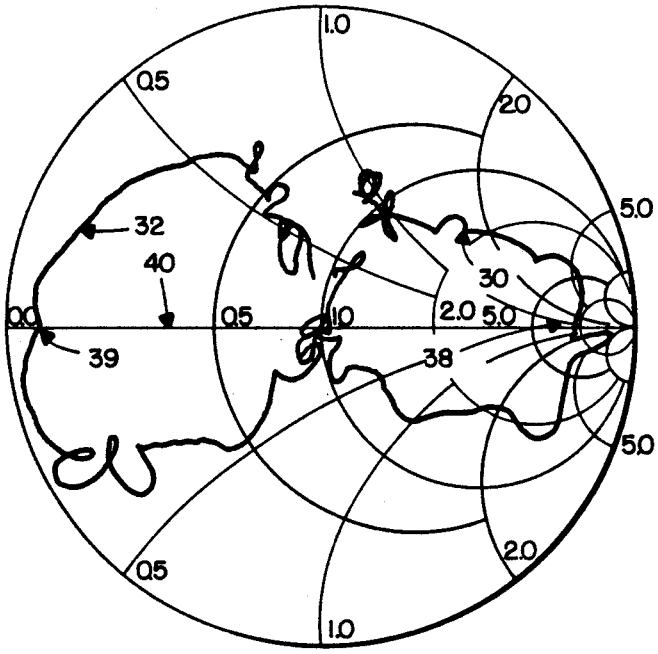
FIG. 3 shows the reflection coefficients of the slot mode and the probe mode as functions of frequency as they appear when plotted on a Smith Chart.

A number of prototypes of the invention have been constructed. The dimensions of the model shown in FIGS. 1 and 2a (with 5 pF capacitor 24) were:

Circular patch 10 radius—6 cm
Patch height above ground plane —0.3175 cm
Rectangular aperture 22 dimensions —8.3×0.1 cm
Substrate 17 thickness for feeder—0.3175 cm The dimensions of a later model modified as shown in FIG. 2b were:

Circular radiating patch 10 radius —3.49 cm
Patch height above ground plane —0.4
Circular coupling patch 27 radius —1.0 cm
Rectangular aperture 22 dimensions —6.0×0.1 cm
Substrate 17 thickness for feeder —0.159 cm The reflection coefficient presented to the feeder 16 by the slot mode of the patch (with the capacitor removed) is shown from actual measurements taken from a prototype of the invention as locus 30 in the Smith Chart of FIG. 3. Points on locus 30 near the center of the chart indicate small reflections occur at low frequencies since the low coupling leads to a small value of series impedance. Intersection 38 of the locus 30 with the horizontal line (real axis) 40 indicates the resonance condition for the slot mode.

The impedance presented to feeder 16 by the probe mode of the patch (with the slot length greatly reduced) is shown as locus 32. The intersection 39 of the locus 32 with the horizontal line 40 indicates the resonance condition for the probe mode. One objective of the design of the dual-mode patch is to make the resonant frequencies of the slot mode and the probe mode equal. A further objective for best operation is to make any point on locus 30 correspond at that frequency to the image through the center of the chart of the point on the locus 32 at the same frequency. Some departure from this ideal condition is evident in the prototype's measured data of FIG. 3.

Figure 4:
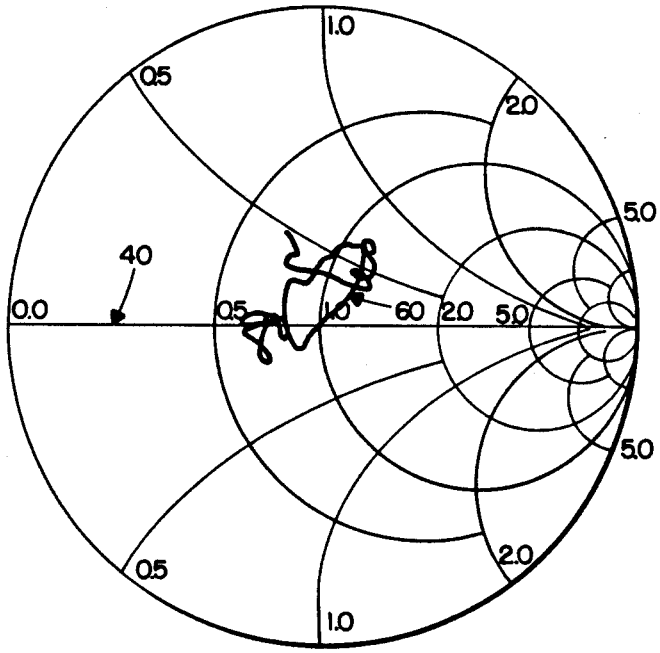
FIG. 4 shows the Smith Cart plot of the reflection coefficient that the combined slot and probe modes present to the feeder.

When the antenna is constructed as shown in FIG. 1, (i.e. with both aperture and probe coupling) and a matched termination is placed on the port not being fed from a signal source, the impedance presented to the feed port at the reference plane 50 was measured to be as shown in FIG. 4. The impedance locus 60 remains near the center of the chart, indicating a small reflected wave even though the coupling may be appreciable, particularly near resonance, for all frequencies from 500 to 1165 MHz. This represents a much better match to the impedance of the feeder than either of the loci 30 or 32 and it remains close to the real axis 40 over this entire band whereas typical impedance loci for resonant patch antennas resemble 30.

Figure 5:
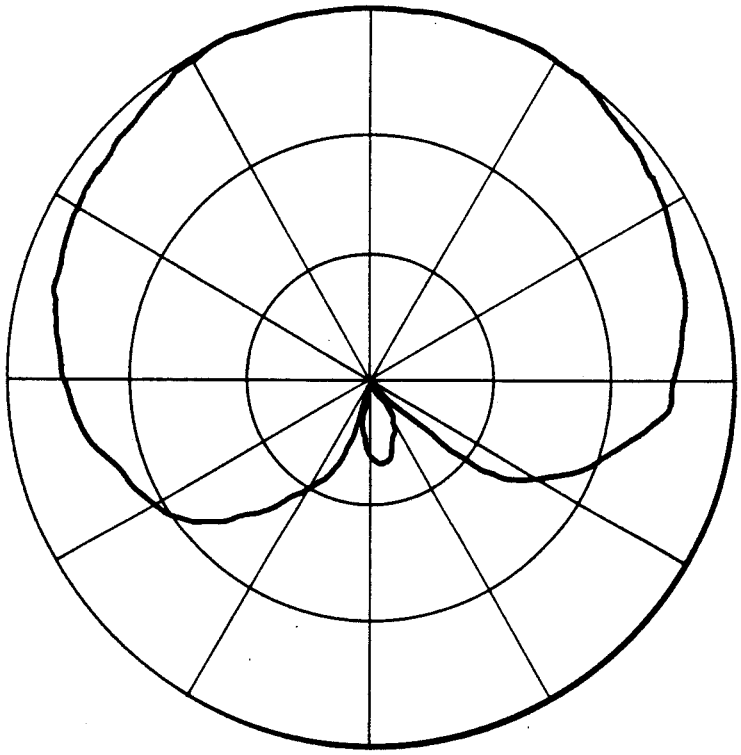
FIG. 5 is a radiation pattern measured as a function of azimuthal angle just above the ground surface.

The radiation pattern shown in FIG. 5 was measured by fixing a second antenna immediately above a large (20-ft by 20-ft) ground plane and placing the dual-mode patch in a rotatable manner on a centrally located section of the ground plane. The received signal level as a function of the angle of rotation is displayed in FIG. 5. The cardioid shape shown is useful for several applications. The additional directivity represented by the cardioid provides a higher level of received signal as compared to that of an antenna having a circular (omnidirectional) pattern. The directivity in the azimuthal plane also provides a means of discriminating among signals carried by waves traveling in different directions. Usually only one of these signals is desired and all the others represent noise and/or interference. Actually, since the dual-mode patch has two ports, two directive patterns are simultaneously available from a single antenna. The pattern maximum lies in the direction along the feeder proceeding from the feedpoint out to the connected port. Hence, a receiver connected to a particular port will receive best from the direction associated with that port but, when switched to the other port, will receive best from the opposite direction. This provides a type of diversity reception that is useful to combat deep fades of the signal in urban locations where waves may arrive at the antenna of a mobile receiver from many different directions. Another application of the dual-mode patch is in direction-finding or homing systems where a simultaneous or sequential comparison is made of the signals on the two ports in order to determine the direction of arrival of the incident wave.

Figure 6:
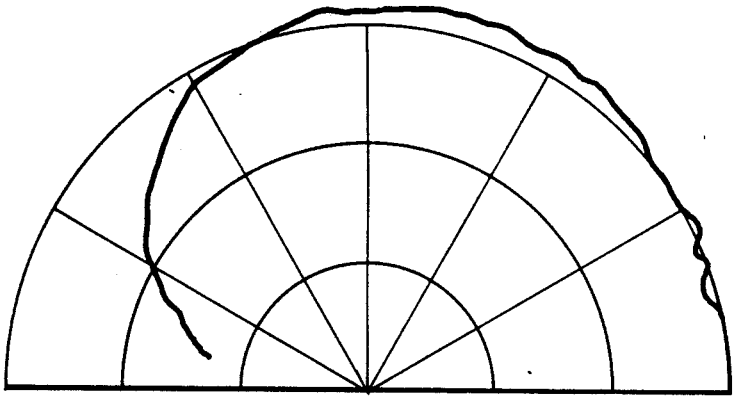
FIG. 6 is a radiation pattern measured as a function of the elevation angle in a vertical plane through the centerline of the feeder.

The unidirectional property of the patterns of the dual-mode patch is also apparent from the pattern measured in the elevation plane (FIG. 6). This measurement is accomplished by moving a second antenna on a semicircular path in a plane perpendicular to the large ground plane while keeping fixed the rotating plate holding the dual-mode patch antenna.

We claim:

1. A substantially planar configuration antenna comprising:

a ground plane of conducting sheet material having upper and lower surfaces;

an aperture provided within said material, the dimension of said aperture in one direction being greater than the dimension in the orthogonal direction;

a conductive, planar, patch means spaced from and parallel to said upper surface of said ground plane, and positioned so that a central portion of said patch means is above a central portion of said aperture, said planar patch means extending over and completely encompassing said aperture, said aperture's size being insufficient to accomplish substantial radiation from said aperture;

transmission line feed means having opposite ends and spaced from and parallel to said lower surface of said ground plane and being axially oriented substantially orthogonal to the direction of said greater dimension of said aperture and extending beyond and on both sides of said aperture;

capacitive reactance means positioned in said aperture and connected between said feed means and said patch means, the value of said capacitive reactance means controlling the resonant frequency of said patch means;

said antenna being further characterized in that when an electromagnetic wave is initiated at either end of said transmission line feed means, with the opposite end terminated in a matched impedance, such initiation results in a small reflected wave being generated on the feed means at the location of the aperture and capacitive reactance means, and whereby energy is coupled from the electromagnetic wave initiated on said feed means and radiated into the space above the ground plane through the space separating the patch means from said ground plane to form a beam directed away from the center of said patch means in the direction of the end of said feed means at which the wave was initiated.

2. An antenna according to claim 1 which further comprises permittivity dielectric means supporting and separating the patch means from said ground plane.

3. An antenna according to claim 1 which further comprises dielectric substrate means separating said feed means from said ground plane.

4. An antenna according to claim 1 wherein said aperture is rectangular.

5. An antenna according to claim 1 wherein said patch means is a circular disk.

6. An antenna according to claim 1 wherein said feed means is further provided with a first and second feed port at opposite ends wherein the connection of a signal source to the first feed port and the simultaneous connection of a matched termination to the second feed port results in maximum radiation in one direction in space, and the connection of a signal source to the second feed port and the simultaneous connection of a matched termination to the first said feed port results in maximum radiation in the opposite direction.

7. An antenna according to claim 1 wherein said capacitive reactance means is a discrete capacitor.

8. An antenna according to claim 1 wherein said capacitive reactance means comprises a conducting plate of area less than said patch means, connected to said feed means and oriented substantially parallel to said patch means and separated therefrom by a dielectric medium.

9. An antenna according to claim 1 wherein the feed means is a conducting strip.

10. An antenna according to claim 9 wherein the width of said conducting strip is variable with distance from the location of said aperture.

* * * * *